US010569583B2

(12) United States Patent
Knabe et al.

(10) Patent No.: US 10,569,583 B2
(45) Date of Patent: Feb. 25, 2020

(54) METHOD FOR THE AUTOMATED CALIBRATION OF A PRINTING MACHINE

(71) Applicant: HEIDELBERGER DRUCKMASCHINEN AG, Heidelberg (DE)

(72) Inventors: Alexander Knabe, Heidelberg (DE); Manfred Schneider, Bad Rappenau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/211,282

(22) Filed: Dec. 6, 2018

(65) Prior Publication Data

US 2019/0184722 A1 Jun. 20, 2019

(30) Foreign Application Priority Data

Dec. 14, 2017 (DE) ..... 10 2017 222 728

(51) Int. Cl.

| | |
|---|---|
| ***B41J 29/393*** | (2006.01) |
| ***B41J 2/045*** | (2006.01) |
| ***B41J 2/21*** | (2006.01) |
| ***B41J 11/46*** | (2006.01) |
| ***B41J 25/00*** | (2006.01) |

(52) U.S. Cl.

CPC ..... *B41J 29/393* (2013.01); *B41J 2/04558* (2013.01); *B41J 2/2135* (2013.01); *B41J 2/2139* (2013.01); *B41J 2/2142* (2013.01); *B41J 2/2146* (2013.01); *B41J 11/46* (2013.01); *B41J 2025/008* (2013.01)

(58) Field of Classification Search

CPC ..... B41J 29/393; B41J 11/46; B41J 2/2146; B41J 2/2135; B41J 2/2142; B41J 2/2139; B41J 2/04558

See application file for complete search history.

(56) References Cited

U.S. PATENT DOCUMENTS

| | | | |
|---|---|---|---|
| 7,818,072 | B2 | 10/2010 | Betzmeier et al. |
| 2006/0227352 | A1 | 10/2006 | Mamberer |
| 2014/0079293 | A1 | 3/2014 | Kitai et al. |

FOREIGN PATENT DOCUMENTS

| | | | |
|---|---|---|---|
| DE | 102004040093 | A1 | 3/2006 |
| DE | 102005015746 | A1 | 10/2006 |

*Primary Examiner* — Julian D Huffman

(74) *Attorney, Agent, or Firm* — Laurence A. Greenberg; Werner H. Stemer; Ralph E. Locher

(57) ABSTRACT

A method for the automated calibration of a printing machine with an image capture system by using a computer, includes putting at least one printed sample substrate with defined deviations into the printing machine, generating a digital image of the printed sample substrate by using the image capture system, calculating current compensation values including defined deviations for configuration parameters of the printing machine relating to optimizing the printing quality by using the computer, and comparing the current compensation values created with target compensation values known from the defined deviations of the printed sample substrate. Serviceability of the printing machine is checked by evaluating the comparison by the computer and/or calibrating the printing machine by using the evaluated comparison by the computer.

11 Claims, 3 Drawing Sheets

METHOD FOR THE AUTOMATED CALIBRATION OF A PRINTING MACHINE

CROSS-REFERENCE TO RELATED APPLICATION

This application claims the priority, under 35 U.S.C. § 119, of German Patent Application DE 10 2017 222 728.1, filed Dec. 14, 2017; the prior application is herewith incorporated by reference in its entirety.

BACKGROUND OF THE INVENTION

Field of the Invention

The present invention relates to a method for the automated calibration of a printing machine with an image capture system by using a computer.

The invention lies in the technical field of test automation.

Conventional offset printing machines are in practice checked for complete serviceability following their assembly after the production of the individual components. That is normally done in such a way that a test print which covers as wide a spectrum as possible of functions of the relevant printing machine is carried out. Faults found in the relevant printing machine can thus still be eliminated in production at the manufacturer. After that, the printing machine can be released and delivered to the appropriate customer.

A comparable procedure is currently not possible in inkjet printing machines. The reason for that resides in the fact that, between such a functional test, also called proofing, and the mounting and commissioning of the inkjet printing machine in the printshop at the customer, there is a relatively long time period of normally several days. During that time, depending on the storage of the corresponding print heads of the inkjet printing machine, it is possible for the ink that has remained in the printing nozzles to dry out, which represents a massive risk for the serviceability of the inkjet printing machine. Since, in addition, as a non-contact printing process, inkjet printing has substantially fewer causes of faults with regard to the mechanical serviceability of the inkjet machine than in the case of offset printing machines, so that the readiness of manufacture and customer to dispense with a final functional test following production of the printing machine is far greater than in offset printing. Added thereto is additionally the fact that typical offset printing fault patterns, such as ghosting, which is tested during proofing in an offset printing machine, cannot occur at all in digital inkjet printing machines, because of the construction. In addition, optimization steps with regard to the necessary adjustments, such as gear shifting, are then expediently possible only when proofing has previously been carried out. Since, for the aforementioned reasons, that is not possible in inkjet printing, that is a further reason why proofing is omitted in an inkjet printing machine. The serviceability of an inkjet printing machine is in any case substantially determined through the condition of the print heads and the control software, more precisely specific software algorithms, such as those for the detection and compensation of failed printing nozzles.

In order to test those functions, the action in the prior art was previously carried out in such a way that the proofing and therefore the test of the serviceability of the aforementioned components in the inkjet printing machine was carried out only after the mounting of the machine in the print shop at the customer. However, that has the disadvantage that any damage or problems on the inkjet printing machine can then only be discovered at the customer. If they are problems which cannot be eliminated on site, at least the relevant components of the inkjet printing machine have to be replaced, which is associated with additional outlay and costs and a loss of image of the manufacturer. It would therefore be advantageous to nevertheless carry out the proofing for the inkjet printing machines in production at the manufacturer, despite all the aforementioned disadvantages. For that purpose, for example, instead of the ink supply system of the inkjet printing machine, a dummy unit can be installed, with which the proofing for the inkjet printing machine to be tested is then accordingly carried out. The properties of the dummy unit differ from the actually used ink supply unit, however, which makes the test results obtained in that way less valuable. There is also the possibility of using the actual ink supply system of the ink jet printing machine, but then that has to be emptied after the proofing and replaced by another, non-drying, liquid, in order to prevent the remaining aqueous ink in the printing nozzles from drying out. However, experience in practice shows that even such a procedure cannot completely prevent ink from drying out in the printing nozzles. Ultimate security against damage to the print heads in the inkjet printing machine is ensured only when no ink has to be put into the system for the proofing procedure.

Such a procedure without using inks can therefore be done only by using a type of simulation. The prior art shows a printing machine simulator in German Patent Applications DE 10 2004 040 093 A1, corresponding to U.S. Pat. No. 7,818,072 and DE 10 2005 015 746 A1, corresponding to U.S. Publication No. 2006/0227352. That simulator, which is not disclosed specifically for inkjet printing machines but generally for printing machines, is conceived for training purposes in the training of printers. The simulation is integrated into the control desk of the printing machine and has a database with which the behavior of the printing machine with specific inputs can be simulated and output on the control desk. The integration into the control desk of the printing machine ensures that those in training are trained as far as possible in a manner close to reality. However, the simulator has no access to the printing machine behind it and, in addition, does not carry out any true printing processes or other activations of the real printing machine but is supported solely on its intrinsic database with its theoretical values. Such a system is also completely sufficient for the training of young apprentices. However, since no real data is processed, such a simulator is of no use for the testing of the serviceability of a real inkjet printing machine.

SUMMARY OF THE INVENTION

It is accordingly an object of the invention to provide a method for the automated calibration of a printing machine, which overcomes the hereinafore-mentioned disadvantages of the heretofore-known methods of this general type and which ensures the serviceability of the printing machine without having to carry out a complete printing process.

With the foregoing and other objects in view there is provided, in accordance with the invention, a method for the automated calibration of a printing machine with an image capture system by using a computer, which comprises the steps of putting at least one printed sample substrate with defined deviations into the printing machine, generating a digital image of the printed sample substrate by using the image capture system, calculating current compensation values including defined deviations for configuration parameters of the printing machine related to optimizing the printing quality by using the computer, comparing the current compensation values created with target compensation values known from the defined deviations of the printed sample substrate, and checking the serviceability of the printing machine by evaluating the comparison by the computer and/or calibrating the printing machine by using the evaluated comparison by the computer.

The actual core of the invention resides in putting a real printed sample substrate into the machine and thus simulating a real printing operation. Since real printing must not be carried out in the method according to the invention, the print heads are deactivated and only the printed sample substrate is put into the printing machine. After that, with the aid of an image capture system with which the printing quality is otherwise checked in the real printing process, the printed sample substrate is captured and evaluated. Since the printed sample substrate contains defined deviations with regard to printing quality and other parameters, which simulate a malfunction of the machine, the image capture system can thus be used to calculate a set of current compensation values for the configuration parameters of the printing machine which takes into account these defined deviations on the printed sample substrate. These current compensation values are intended to appropriately compensate the faults in the printing machine simulated by the printed sample substrate having the defined deviations. Since the deviations on the printed sample substrate are defined and thus known, of course logically target compensation values which correspond to ideal compensation values with which the simulated faults can be compensated as well as possible are therefore known. By using a comparison of the created current compensation values with the known target compensation values, it is then possible to check whether the printing machine operates correctly in its production run after the printing units or the print heads. Thus, for example, the serviceability of the substrate transport in the printing machine can be checked, as can the entire color control of the printing machine, including the function of the image capture system. By using the findings about the condition, i.e. the serviceability, of the printing machine which, for example, emerge from the difference between created current compensation values and the known target compensation values, it is possible to calibrate the printing machine accordingly for the most accurate serviceability, in that possible malfunctions are revealed immediately.

One preferred development of the method according to the invention is that the at least one printed sample substrate is pre-printed in an identical printing machine or has been produced on another printing device, for example a proof plotter with at least the resolution as in the printing machine. Whether the printed sample substrate is then produced in an identical printing machine or another printing device, such as a proof plotter with a correspondingly very high resolution of the printed image, depends firstly on the existing hardware but primarily on which test scenario it is wished to carry out within the context of the method according to the invention. For a test as close as possible to reality, which is intended to supply results which lie as close as possible to real proofing, it is primarily the print in an identical sister machine that is recommended. However, if specific parameters are to be tested as accurately as possible, for example with regard to the color control or possible failed print nozzles in an inkjet printing machine, then it may also be expedient to produce the printed sample substrate in a proof plotter which has a correspondingly high image resolution.

Another preferred development of the method according to the invention is that, in addition to a first pass with the input of at least one printed sample substrate with defined deviations, in a second pass at least one digital test image is fed into the image capture system, for the test image current compensation values including defined deviations are calculated by the computer for configuration parameters of the printing machine relating to optimizing the printing quality, and these are compared with the current compensation values from the first pass and the target compensation values, in order thus to assess the serviceability of the data production and processing from the image capture system through the data paths and compensation algorithms as far as the printing units of the printing machine. This second pass with a digital test image which is put into the image capture system has the effect of taking a still closer look at the production section of the printing machine which is tested after the printing units or print heads. The fact that this second pass is only used later in the production line, namely after the image recording by the image capture system, means that in this second pass the area which is located between the image recording of the printed sample substrate and the calculation of the current compensation values is examined. Possible faults in the substrate transport and faults in the image capture system, for example in the camera, which lie in the process section before the processing of the image data in the image capture system, can be determined in an accurately targeted manner if sample substrate and digital test image are the same. For this purpose, the created current compensation values from the second pass, which have been created by using the digital test image, are compared with the current compensation values from the first pass, which have been determined by using a printed sample substrate actually put into the machine. If they differ, it is possible to conclude that there is clearly a fault in the production section of the printing machine between the start of the first pass in the printing machine and the start of the second pass in the printing machine. Through the use of the further comparison of the two created current compensation values in the first pass and second pass with the target compensation values, it is possible to localize faults that have occurred in an accurately targeted manner to the location of their occurrence in the printing machine in the tested production process. This is advantageous in particular in inkjet printing machines since, as has already been mentioned, the printing quality is substantially induced by the condition of the print heads but primarily also by the software and various calculation algorithms of the software. It is also conceivable that only this second pass with the digital test image and without the first pass with the printed sample substrate is carried out. Then, by comparing the current and target compensation values, the area which lies between the image capture of the printed sample substrate and the calculation of the current compensation values can be examined and the insertion of the sample substrate can be omitted. In this case, however, it is not possible to determine the part of the process path on which faults are located and the functioning of the image capture system and of the substrate transport cannot be checked.

A further preferred development of the method according to the invention is that, by using the comparison of first and second pass without printing operation, a check of the printing machine for hardware problems and cabling, addressing, firmware and software faults is carried out. In the production path which is tested between the first pass with actually printed sample substrate and the second pass with the feeding-in of a digital test image, it is primarily possible to test for hardware problems. These relate, for example, to the transport of the substrate and the condition of the image capture system, in particular with regard to the camera or the illumination of the camera, etc. In addition, by using the comparison of first and second pass, it is also possible to find cabling, addressing and software faults which are responsible for faulty functions of the corresponding components in this section between first and second pass on the production path of the printing machine.

An added preferred development of the method according to the invention is that the hardware problems include the printing substrate transport and camera adjustments or lens faults of the image capture system. The hardware problems primarily relate to the transport of the substrate and the condition of the image capture system, in particular with regard to the camera or the illumination of the camera, lens faults of the camera, etc.

An additional preferred development of the method according to the invention is that multiple printed sample substrates with different density and/or compensation profiles are input in order to generate averaged test results. In order to be able to cover as many test scenarios as possible and also to achieve secured test results, it is recommended to put in multiple different printed sample substrates with different printed images and secondly multiple identical printed images but with different density and compensation profiles in the first pass. As a result, averaged test results are generated, with which in turn considerably better and more accurate test results can be achieved than with a single input printed sample substrate.

Another preferred development of the method according to the invention is that the printing machine is a sheet-fed inkjet printing machine, wherein the printed sample substrate is a sample sheet. Although the method according to the invention can of course also be used for offset and web-fed printing machines, due to the specific requirements on inkjet printing machines with regard to proofing, already explained in the introduction, it is recommended to use the method according to the invention primarily for a sheet-fed inkjet printing machine. In this case, the printed sample substrate logically corresponds to a sample sheet.

An added preferred development of the method according to the invention is that the configuration parameters of the sheet-fed inkjet printing machine include parameters relating to color control of the sheet-fed inkjet printing machine, in particular the ink density and the color value, as well as parameters for controlling the sheet transport and information about failed printing nozzles. The configuration parameters of the sheet-fed inkjet printing machine which are especially to be tested are, as mentioned, primarily the parameters relating to the color control of the sheet-fed inkjet printing machine, in particular then the ink density with the color value, and the configuration parameters for controlling the sheet transport and, above all, also information about failed printing nozzles. These can be checked by the printed sample sheet containing, for example, image artifacts which correspond to the image artifacts of real failed printing nozzles. The color control can be tested very easily by the printed sample sheet containing image regions with deviating color values. Faulty sheet transport can be simulated on the printed sample sheet by using many kinds of approaches, for example by using geometrically deviating positions of the image elements of the printed sample sheet and by appropriate distortions or compressions of the image elements.

A concomitant preferred development of the method according to the invention is that, for the further calibration of the sheet-fed inkjet printing machine, print head data is simulated, in which virtual print heads with defined deviations from normal operation are used. In order to also be able to test extremely important print heads accordingly in the virtual proof for the functioning of an inkjet printing machine, virtual print heads having defined deviations from normal operation are simulated through input print head data. This simulated print head data can be introduced into the method according to the invention through various approaches. For example, it is conceivable that the printed sample sheet not only contains image artifacts from failed printing nozzles but also, for example, other faults which can be caused by an incorrectly functioning print head, for example wrong ink droplet sizes, geometrically deviating printing nozzles, printing nozzles printing too weakly or too intensely as a special case of deviating ink droplet sizes, wrongly aligned print heads, etc. These simulated print head faults can thus be simulated both on the actually printed sample sheet and also in the digital test image of the second pass, wherein, in the latter case, it is also possible to introduce purely theoretically created faults or test data, test patterns, test faults, which are not based on faulty sheets printed with real print heads. The virtual print heads in the form of the input print head data are also used for the assessment of the digitized or digital printing image data in such a way that the computer which carries out the comparison between current and target compensation values must of course also have knowledge, at least through the target compensation values, as to how erroneously printing, virtual print heads act on the printed image.

Other features which are considered as characteristic for the invention are set forth in the appended claims.

Although the invention is illustrated and described herein as embodied in a method for the automated calibration of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. The invention as such and structurally and/or functionally advantageous developments of the invention will be described in more detail below with reference to the associated drawings by using at least one preferred exemplary embodiment.

DETAILED DESCRIPTION OF THE INVENTION

Figure 1:
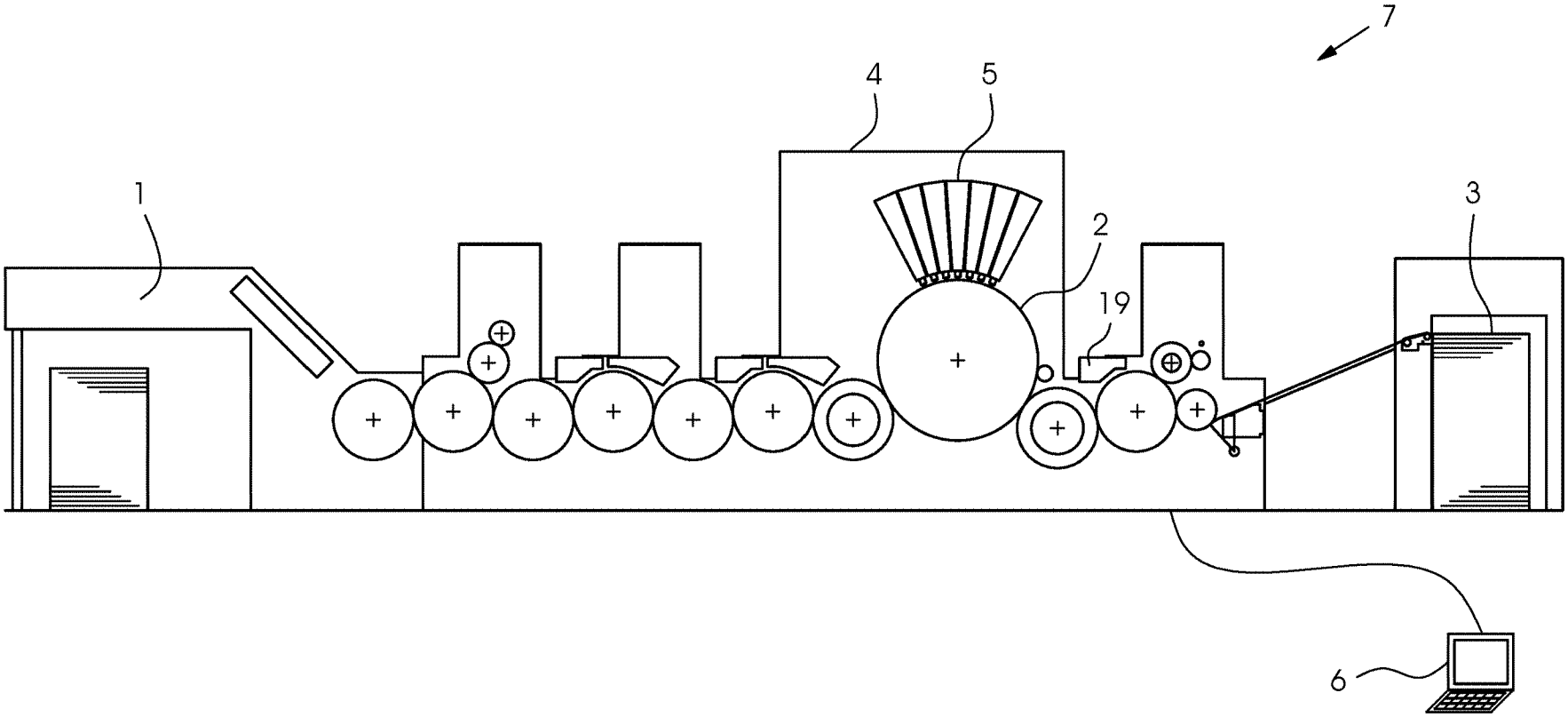
FIG. 1 is a diagrammatic, longitudinal-sectional view of an example of a sheet-fed inkjet printing machine.

Referring now in detail to the figures of the drawings, in which mutually corresponding elements are each provided with the same designations, it is seen that the area of application of the preferred structural variant of the method according to the invention is an inkjet printing machine 7. An example of the fundamental structure of such a machine 7, including a feeder 1 for the supply of a printing substrate 2 into a printing unit 4, where it is printed by print heads 5, leading to a delivery 3, is illustrated in FIG. 1. In this case, this is a sheet-fed inkjet printing machine 7, which is monitored by a control computer 6.

Figure 2:
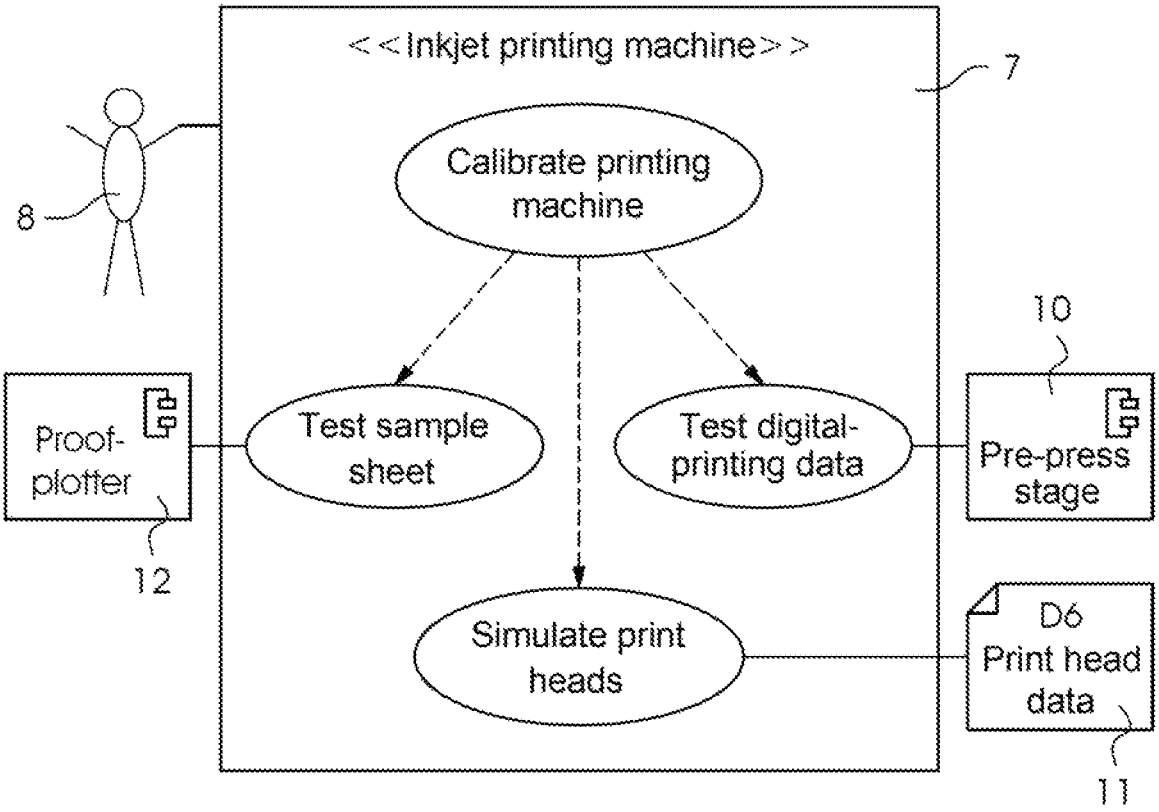
FIG. 2 is a flow diagram showing a specific application of virtual proofing on a sheet-fed inkjet printing machine.
Figure 3:
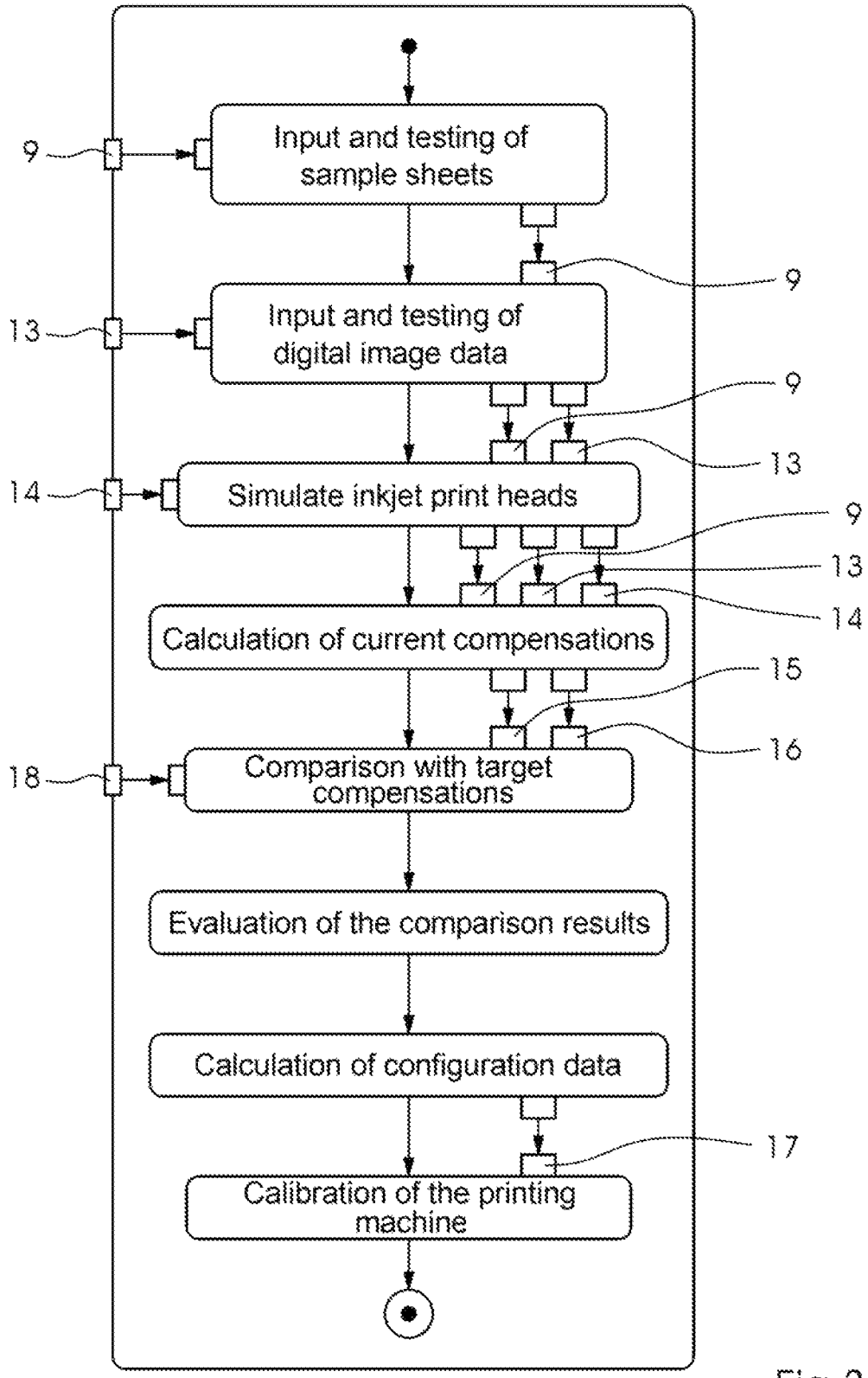
FIG. 3 is a flow diagram showing a sequence of the method according to the invention.

During the assembly or after the assembly of such a sheet-fed inkjet printing machine 7, a complete functional test, including the elimination of found faults by calibration of the just constructed sheet-fed inkjet printing machine 7 is now desirable. This application in a preferred structural variant is disclosed in FIG. 2. Since this cannot be carried out through real proofing as in the case of an offset printing machine, this is done by a user 8 triggering the method according to the invention, in which a sample sheet or printing substrate 2 and digital image data 13 indicated in FIG. 3 are tested and, as a special case, the print heads 5 are simulated. The digital image data 13 are supplied from a pre-press stage 10 or are present as a test image which has been produced specifically for this virtual proofing by the pre-press stage 10. A printed sample sheet 9 is produced by an identical test printing machine 12 or a proof plotter 12. The simulation of the print heads 5 is done by using print head data stored in a database 11.

FIG. 3 illustrates the sequence of the method according to the invention in its preferred structural variant. Firstly, the printed sample sheet 2 is put into the machine 7, captured by the image capture system 19 and the digital printing data thus generated from the printed sample substrate is evaluated in the image capture system. In the next step, digital image data 13 are then fed into the sheet-fed inkjet printing machine 7 by the computer 6, specifically directly into the image capture system 19, which then likewise evaluates this digital image 13. As the next step, the inkjet print heads 5 are simulated. In a particularly preferred structural variant, this step can also be integrated into the first two steps of the input and testing of the printed sample sheet 9 and the digital image data 13. Through the use of the generated evaluation results from the printed sample sheet 9, the digital image data 13 and the simulated inkjet print heads 14, current compensations 15, 16 are then calculated for the defined deviations which the printed sample sheet 9, the digital image data 13 and the simulated inkjet print heads 14 have. This can be carried out by the control computer 6 of the sheet-fed inkjet printing machine 7. In the preferred structural variant, however, this is carried out by an evaluation computer of the image capture system 19. In a further structural variant, the calculation can also be carried out by a further external computer. As the next step, these calculated current compensations 15, 16 are compared with the known target compensations 18. The target compensations 18 correspond to the ideal compensations for these defined deviations assigned to the data 9, 13, 14 by using the known defined deviations. These three different compensation values 15, 16, 18, i.e. the target compensation values 18, the respective current compensation values 15, 16 for the printed sample sheets and for the digital image data and, if present separately, the simulated inkjet print heads 14, are then compared with one another by using the result of this comparison. Corresponding functional faults of the sheet-fed inkjet printing machine 7 to be tested are then determined. For these determined functional faults, corresponding configuration data 17 are then created, with which the sheet-fed inkjet printing machine 7 is calibrated in a further step.

The following is a summary list of reference numerals and the corresponding structure used in the above description of the invention:

1 Feeder
2 Printing substrate
3 Delivery
4 Inkjet printing unit
5 Inkjet print head
6 Computer
7 Sheet-fed inkjet printing machine
8 User
9 Test sample sheet with defined deviations
10 Pre-press system
11 Database with virtual print head data
12 Proof plotter/Test printing machine
13 Digital test image data with defined deviations
14 Virtual/simulated print head data with defined deviations
15 Current compensation values for test sample sheet
16 Current compensation values for digital test image data
17 Configuration data for calibration
18 Ideal target compensation values
19 Image capture system

The invention claimed is:

1. A method for the automated calibration of a printing machine, the method comprising the following steps:

putting at least one printed sample substrate with defined deviations into the printing machine;

using an image capture system of the printing machine to generate a digital image of the printed sample substrate;

using a computer to calculate current compensation values including defined deviations for configuration parameters of the printing machine relating to optimizing printing quality;

comparing the created current compensation values with target compensation values known from the defined deviations of the printed sample substrate; and checking serviceability of the printing machine by at least one of using the computer to evaluate the comparison or using the computer to calibrate the printing machine by using the evaluated comparison.

2. The method according to claim 1, which further comprises at least one of pre-printing the at least one printed sample substrate in an identical printing machine or producing the at least one printed sample substrate on another printing device.

3. The method according to claim 2, which further comprises using a proof plotter with at least a resolution of the printing machine as the other printing device.

4. The method according to claim 1, which further comprises:

carrying out the step of putting the at least one printed sample substrate with defined deviations into the printing machine in a first pass;

feeding at least one digital test image into the image capture system in a second pass;

using the computer to calculate current compensation values including defined deviations for the test image for configuration parameters of the printing machine relating to optimizing the printing quality; and comparing the current compensation values for the test image with current compensation values from the first pass and the target compensation values to assess serviceability of data production and processing from the image capture system through data paths and compensation algorithms as far as printing units of the printing machine.

5. The method according to claim 4, which further comprises using a comparison of the first and second passes without a printing operation to check the printing machine for hardware problems and cabling, addressing, firmware and software faults.

6. The method according to claim 5, which further comprises including printing substrate transport and camera adjustments or lens faults of the image capture system as the hardware problems.

7. The method according to claim 1, which further comprises inputting multiple printed sample substrates with at least one of different density or different compensation profiles to generate averaged test results.

8. The method according to claim 1, which further comprises using a sheet-fed inkjet printing machine as the printing machine, and using a sample sheet as the printed sample substrate.

9. The method according to claim 8, which further comprises including parameters relating to color control of the sheet-fed inkjet printing machine in the configuration parameters of the sheet-fed inkjet printing machine.

10. The method according to claim 8, which further comprises selecting the parameters as ink density, color value, parameters relating to sheet transport control and information about failed printing nozzles.

11. The method according to claim 8, which further comprises simulating print head data for further calibration of the sheet-fed inkjet printing machine by using virtual print heads with defined deviations from normal operation.

* * * * *